United States Patent [19]

Bould et al.

[11] 4,162,385

[45] Jul. 24, 1979

[54] DUAL SPRING CIRCUIT INTERRUPTER APPARATUS

[75] Inventors: Fred Bould, Edgewood Borough; Peter M. Kowalik, Penn Township, Allegheny County, both of Pa.

[73] Assignee: Westinghouse Electric Corp., Pittsburgh, Pa.

[21] Appl. No.: 728,477

[22] Filed: Sep. 30, 1976

[51] Int. Cl.[2] ..... H01H 3/30

[52] U.S. Cl. ..... 200/153 SC; 185/40 R

[58] Field of Search ..... 200/153 SC; 185/37, 185/39, 40; 74/2

[56] References Cited

U.S. PATENT DOCUMENTS

| | | | |
|---|---|---|---|
| 2,748,229 | 5/1956 | Block | 74/2 |
| 3,600,538 | 8/1971 | Puzas et al. | 200/153 SC |
| 3,610,199 | 10/1971 | Prachal | 74/2 |
| 3,689,721 | 9/1972 | McGuffie | 200/153 SC |
| 3,849,619 | 11/1974 | Patel | 200/153 SC |

*Primary Examiner*—Harold J. Tudor

*Attorney, Agent, or Firm*—M. J. Moran

[57] ABSTRACT

A circuit breaker operating mechanism is disclosed having the opening spring thereof disposed within the closing spring thereof. The closing spring has one end thereof affixed to the operating mechanism support base while the other end thereof is movable relative to the support base for being charged and discharged. The encircled opening spring has a first end thereof which is affixed relative to the mechanism support frame. The other end of the opening spring is movable. However, the latter movable end is held temporarily fixed relative to the support base during a charging operation for the closing spring so that the opening spring will be charged with the charging of the closing spring. When a circuit breaker opening operation is necessitated, the non-fixed end of the opening spring is released, thus allowing the opening spring to discharge while the closing spring remains charged. Consequently, the charging operations for both the closing spring and the enclosed opening spring are in compression and may be simultaneous.

3 Claims, 9 Drawing Figures

DUAL SPRING CIRCUIT INTERRUPTER APPARATUS

CROSS REFERENCE TO RELATED APPLICATIONS

The subject matter disclosed and claimed in this application is related to subject matter disclosed and claimed in copending applications Ser. No. 680,829 by F. Bould; Ser. No. 681,274 by F. Bould; and Ser. No. 680,828 by F. Bould and P. Kowalik, all of which were filed on Apr. 28, 1976 and are assigned to the assignee of the present application.

BACKGROUND OF THE INVENTION

1. Field of the Invention

The subject matter of this invention is related generally to operating mechanisms for circuit breaker apparatus and is related particularly to dual, concentric opening and closing coil spring members for circuit breaker operating mechanisms.

2. Description of the Prior Art

It is well known in the prior art to utilize coil springs to provide the force necessary to open and close circuit breaker contacts. Generally in the past, the coil spring for opening the circuit breaker contacts has been physically spaced away from the coil spring for closing the circuit breaker contacts. In addition, one end of each of the springs has been generally affixed to the frame of the circuit breaker mechanism. Examples of such prior art construction are shown in U.S. Pat. No. 3,183,332, issued May 11, 1965 to R. E. Frink et al, U.S. Pat. No. 3,585,330, issued June 15, 1971 to F. Bould, U.S. Pat. No. 3,590,192, issued June 29, 1971 to F. Bould, and U.S. Pat. No. 3,600,540, issued Aug. 17, 1971 to F. Bould. All of the above-mentioned patents are assigned to the assignee of the present application. In addition, U.S. Pat. No. 3,898,409, issued Aug. 5, 1975 to R. Liebig et al shows a similar spaced apart dual spring arrangement. The concept of utilizing separately acting coiled springs, one inside the other, where one is for opening the circuit breaker mechanism and one is for closing the circuit breaker mechanism, where both springs are charged to compression and released from that disposition for providing circuit breaker contact movement has not been found in the prior art. It should be noted that U.S. Pat. No. 3,549,843, issued Dec. 22, 1970 to G. A. Wilson teaches one spring operating inside the other. However, the function of the two coil springs is merely redundant, or supplemental—that is to say, two coil springs are utilized to provide more force than one coil spring could provide for a circuit breaker closing operation. Other prior art which has been found is the German patent open to inspection No. 1,415,646 filed 9th, March 1961 and open to inspection 30th, April, 1969, entitled, "Actuating Device For An Electrical Switch" by W. Zimmermann. In this patent, two coiled springs, one operating inside the other, where one is utilized for opening circuit breaker contacts and one is utilized for closing circuit breaker contacts, is taught. However, in the apparatus taught in the previously described West German patent, it is required that one of the springs operates in tension as the other spring operates in compression. It would be advantageous, therefore, if a dual, concentric, coil spring circuit breaker contact opening and closing apparatus could be found where both of the coiled springs are charged into compression and released from that point for useful operation.

SUMMARY OF THE INVENTION

In accordance with the invention, a circuit interrupter is taught having an operating mechanism which comprises a support, where contact closing means are disposed in mechanical relationship with the contacts of a circuit interrupter for closing the contacts. Releasable contact opening means is disposed upon the support in mechanical relationship with the contacts of the circuit interrupter for opening the contacts. In addition, closing spring means are disposed upon the support. The closing spring means has a first end which is disposed in fixed relationship with the support and a second end which is movable relative to the support between a first position when the spring is charged and a second position when the spring is discharged. The second end is disposed in mechanical relationship with the contact closing means to initiate a closing operation for the contact closing means upon discharge of the closing spring means. Also provided is an opening spring means which is disposed upon the support. The opening spring means has a first end which is affixed to the support. The opening spring also has a second end which is connected in mechanical relationship with the contact opening means and is maintained in a generally fixed position thereby prior to an opening operation. The second end of the opening spring moves upon release of the contact opening means to discharge the opening spring tension to thus force an opening operation of the contact opening means. Charging means are also provided for charging the closing spring. Finally, releasing means are provided for releasing the contact opening means.

BRIEF DESCRIPTION OF THE DRAWINGS

For a better understanding of the invention, reference may be had to the preferred embodiments shown in the accompanying drawings, in which.

DESCRIPTION OF THE PREFERRED EMBODIMENTS

Figure 1:
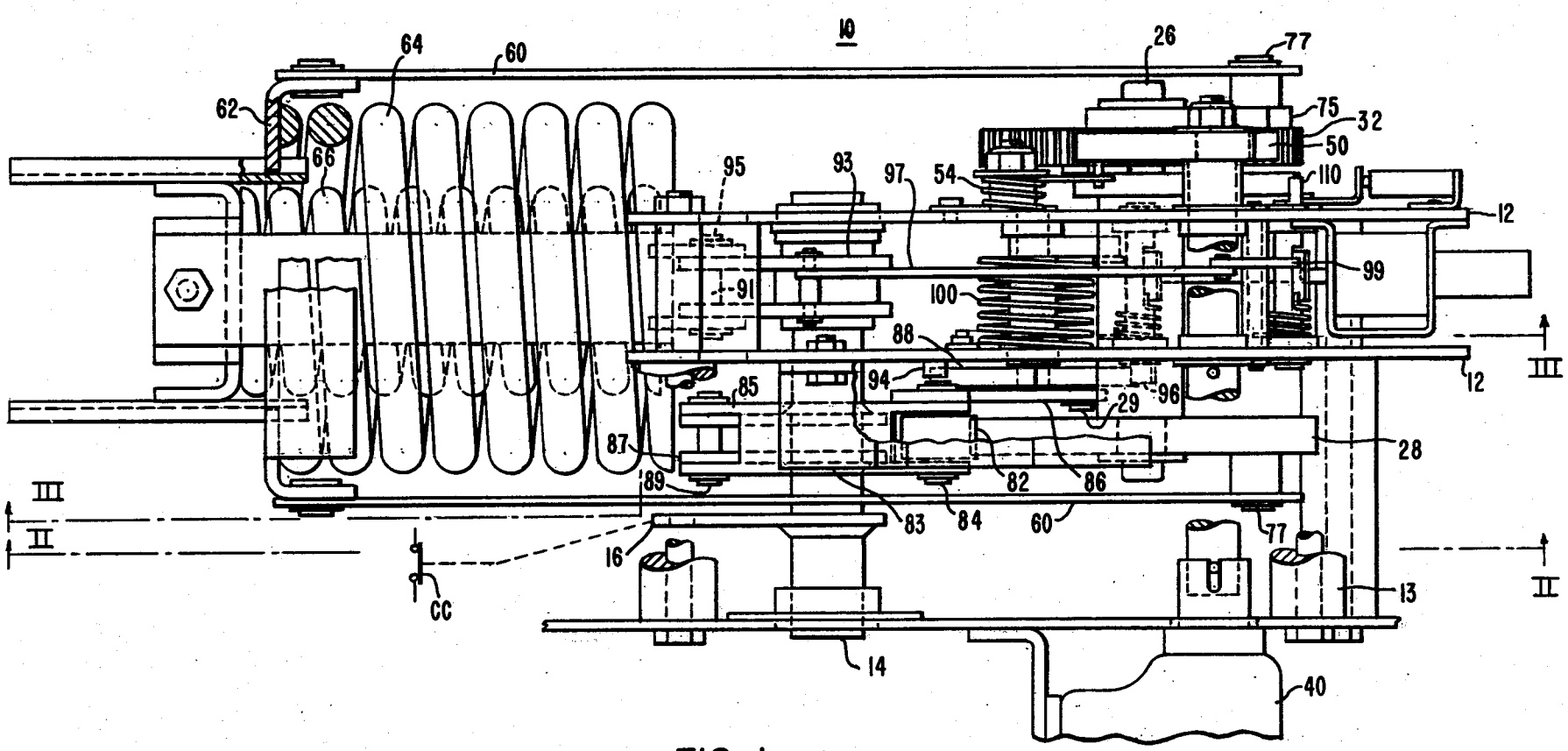
FIG. 1 shows a top view, partially broken away, partially in section, and partially in schematic form of a circuit breaker with an operating mechanism.
Figure 2:
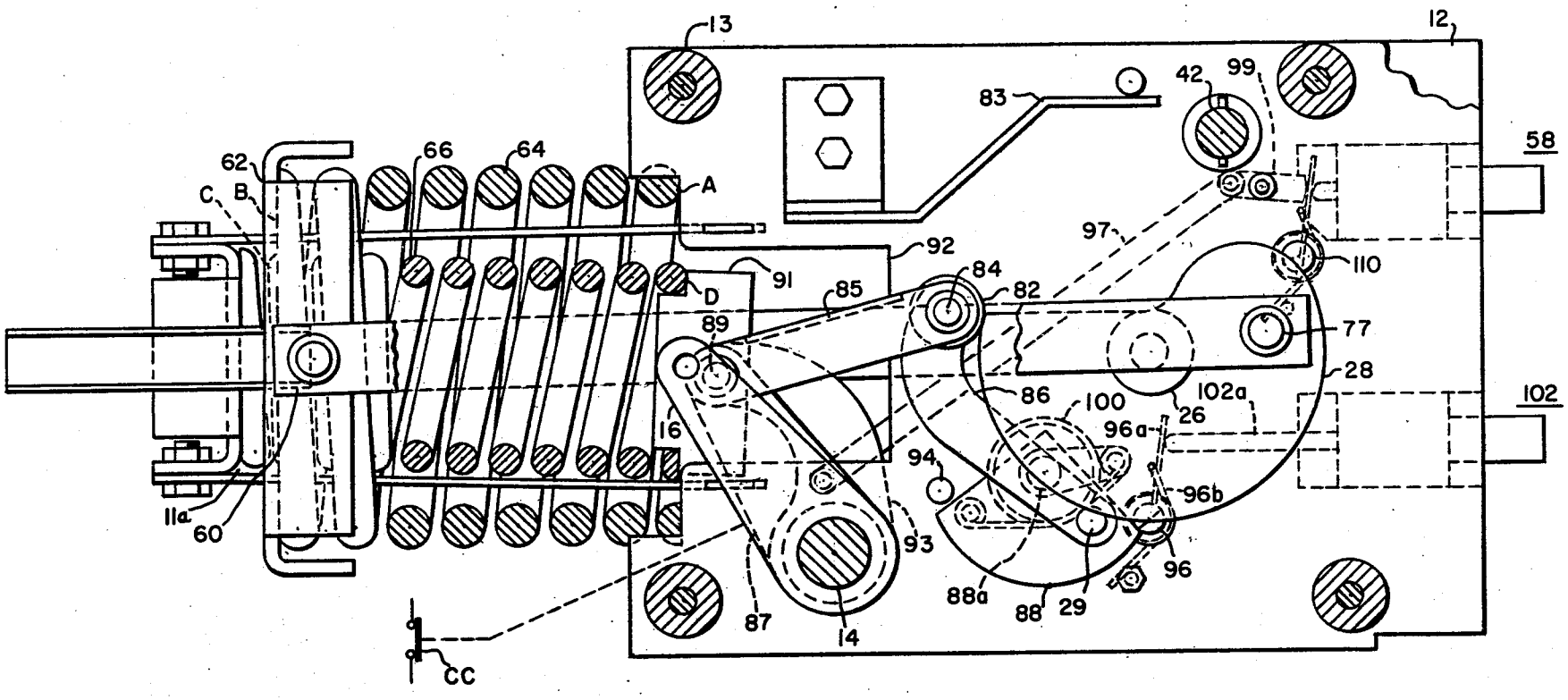
FIG. 2 shows an elevation of the apparatus of FIG. 1 along the section II—II of FIG. 1.
Figure 4:
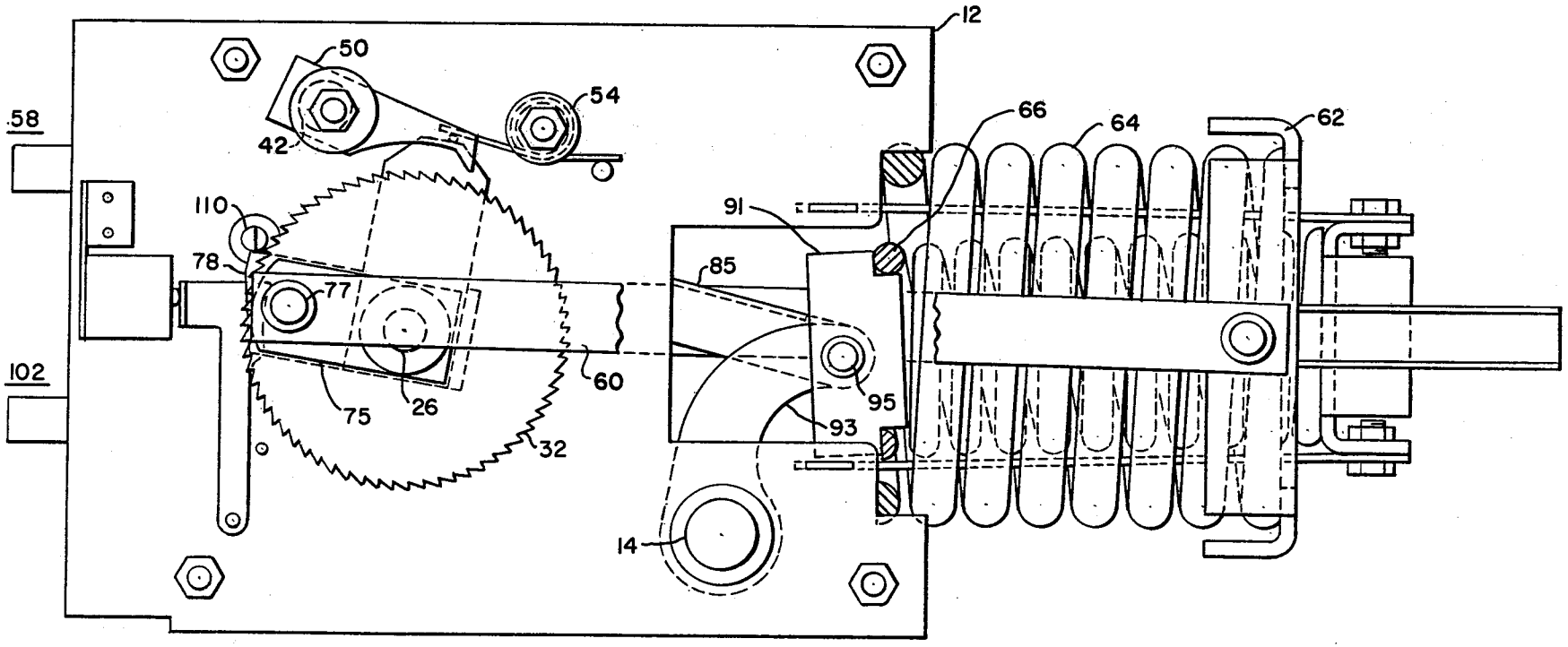
FIG. 4 shows a side elevation of the apparatus of FIG. 1 partially broken away and partially in section viewed from the opposite direction of the views shown in FIGS. 2 and 3.

Referring now to the drawings, and FIGS. 1, 2 and 4 in particular, an operating mechanism 10 for a circuit breaker apparatus is shown. The operating mechanism 10 comprises support plates or frame members 12 which support other portions of the operating mechanism 10. Convenient spacer members 13 are provided for spacing appropriate parts of the support members 12 and for attaching the support members 12 and therefore the operating mechanism to other parts of the circuit breaker apparatus which are not shown for convenience of illustration. There is provided a jack shaft 14 which extends through a number of the support plates 12 and which may rotate in the support plates 12 for performing certain circuit breaker operations. Disposed upon the jack shaft 14 is an operating lever 16 which is shown in the drawings as being disposed in physical relationship with circuit breaker contacts CC for opening and closing the circuit breaker contacts CC. There is also provided a cam shaft 26 which also extends through the support plates 12. The cam shaft 26 has disposed on one end thereof a cam 28 and on the other end thereof a ratchet 32. There is also provided a cranking motor 40 which drives a shaft 42. The shaft 42 rotates an eccentric driving pawl 50 which is spring loaded by a spring 54 to rotate the ratchet 32. Connected to pins 77 on the ratchet wheel 32 and the cam 28 are parallel connecting rods 60 which are attached at the other ends thereof to a spring yoke 62. The yoke 62 abuts one end of a circuit breaker contact closing spring 64. The other end of the closing spring 64 is fixed against portions of the support plates 12. There is also provided an opening spring 66 one end of which is fixed by the rods 11 and the other end which is fixed against a movable yoke 91. The yoke 91 is connected by way of pin 95 to an opening spring crank 93. The opening spring crank 93 is affixed to the previously described jack shaft 14. A portion of the opening spring crank 93 is pinned to a driving rod 97, which in turn, is connected to a closing coil mechanism 99. The yoke 91 may be moved generally translationally to rotate the crank 93. The extent of movement of the yoke 91 is limited by a ledge 92 in a support member 12. A lever 87 is keyed to the jack shaft 14. The other end of the lever 87 is pinned by way of pin 89 to a main link 85. The other end of the main link 85 is pinned by way of pin 84 to a banana link 86. The banana link 86 is pinned to a trip latch 88. Also rotatably disposed on the pin 84 is a roller 82 which may ride upon the surface of the cam 28. In certain operating conditions, the roller 82 may move away from the cam surface of the cam 28 and may abut against a roller bumper 83. The banana link 86 is pinned to the trip latch 88 by way of pin 29. Trip latch 88 is pivoted on an appropriate pivot pin **88*a* in one of the support members 12. As viewed in FIG. 2, the trip latch 88 may rotate clockwise to a bumper pin 94. Counterclockwise motion of the trip latch 88 may be restrained by a trip release shaft 96 in appropriate circumstances. One portion of the trip release shaft 96 is milled away or otherwise removed so that the trip latch 88 may rotate past the trip shaft 96 when the angular disposition of trip shaft 96 is altered by appropriate movement in the trip coil arrangement 102. The trip latch 88 is spring loaded by a spring 100 to quickly return it to its position against the bumper pin 94 as is shown best in FIG. 2**.

Figure 3:
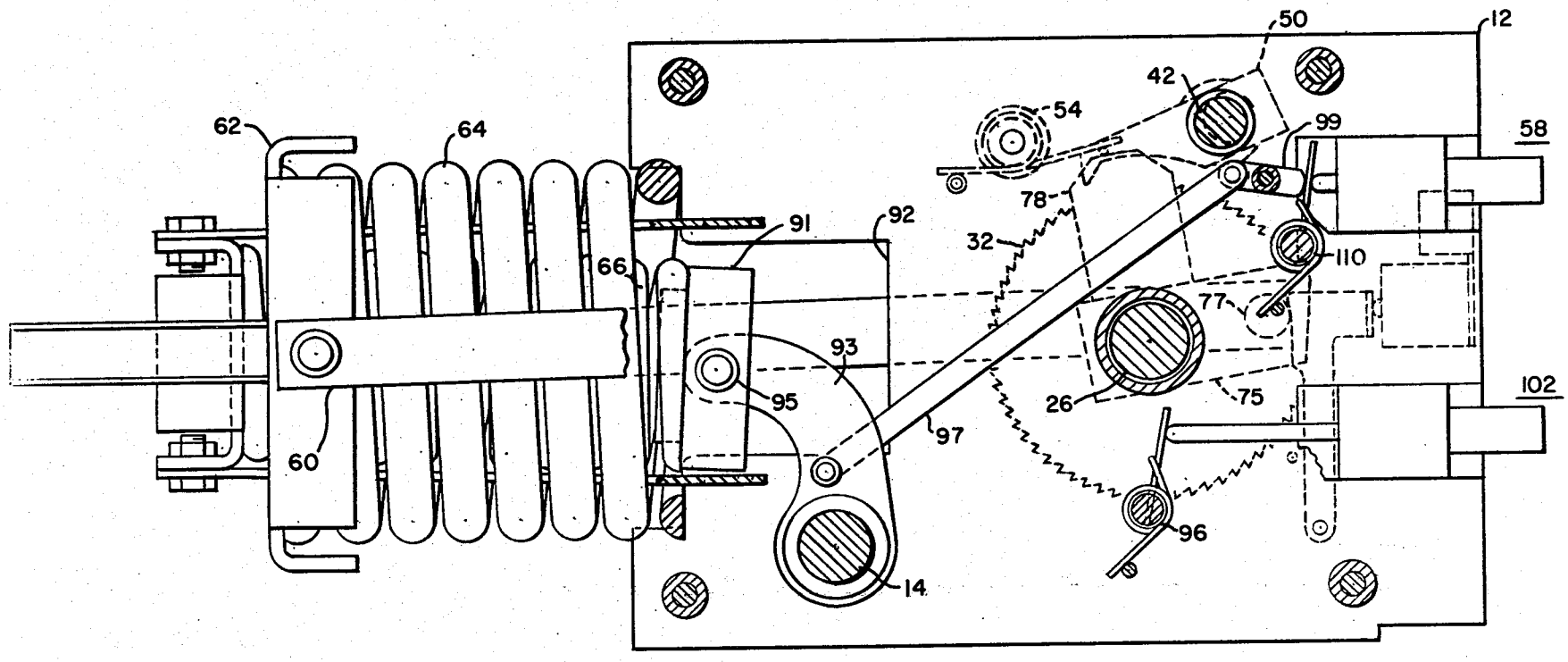
FIG. 3 shows an elevation of the apparatus of FIG. 1 along the section III—III of FIG. 1.

By referring to FIGS. 3 and 4 it can be seen that there is also provided a closing trip shaft 110 which may be operated by a closing coil 58. A lever 78 which is attached to the ratchet 32 is allowed to freely pass by the face of the closing trip shaft 110 when the tripping coil 58 has been actuated to rotate the closing trip shaft 110 in a clockwise direction as viewed in FIG. 4. A free-moving lever member 75 is keyed with the ratchet 32 such that the ratchet 32 drives the lever 75 to in turn move the connecting rod 60 to charge the springs 64 and 66 during the spring charging operation. Actuation of the closing solenoid 58 allows the lever 75 to move without corresponding movement of the ratchet 32 to allow the spring 64 to discharge at an appropriate time. Renewed interlocking of the lever 75 with the ratchet 32 takes place during a subsequent charging cycle.

Figure 5:
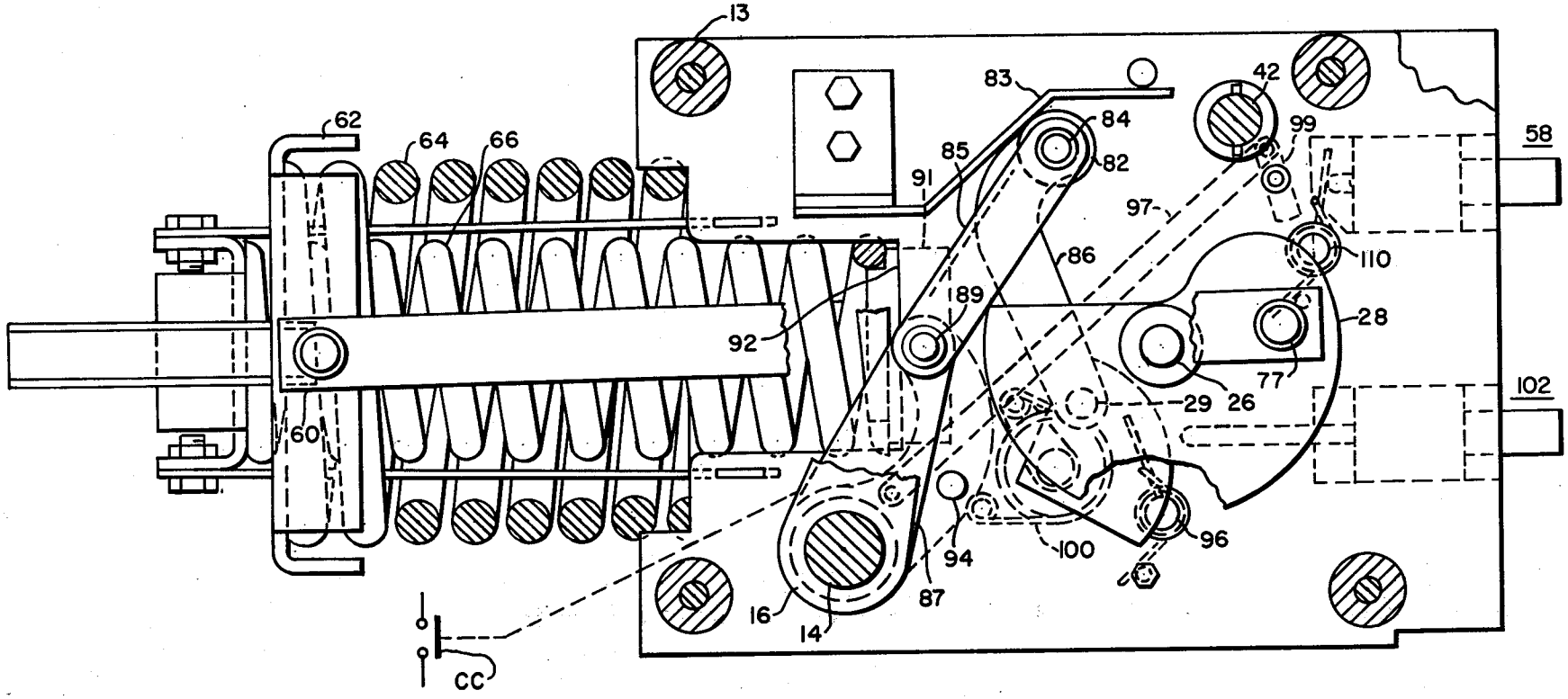
FIG. 5 shows a view shown in FIG. 2 but with the apparatus in the first stage of a second operating position.
Figure 6:
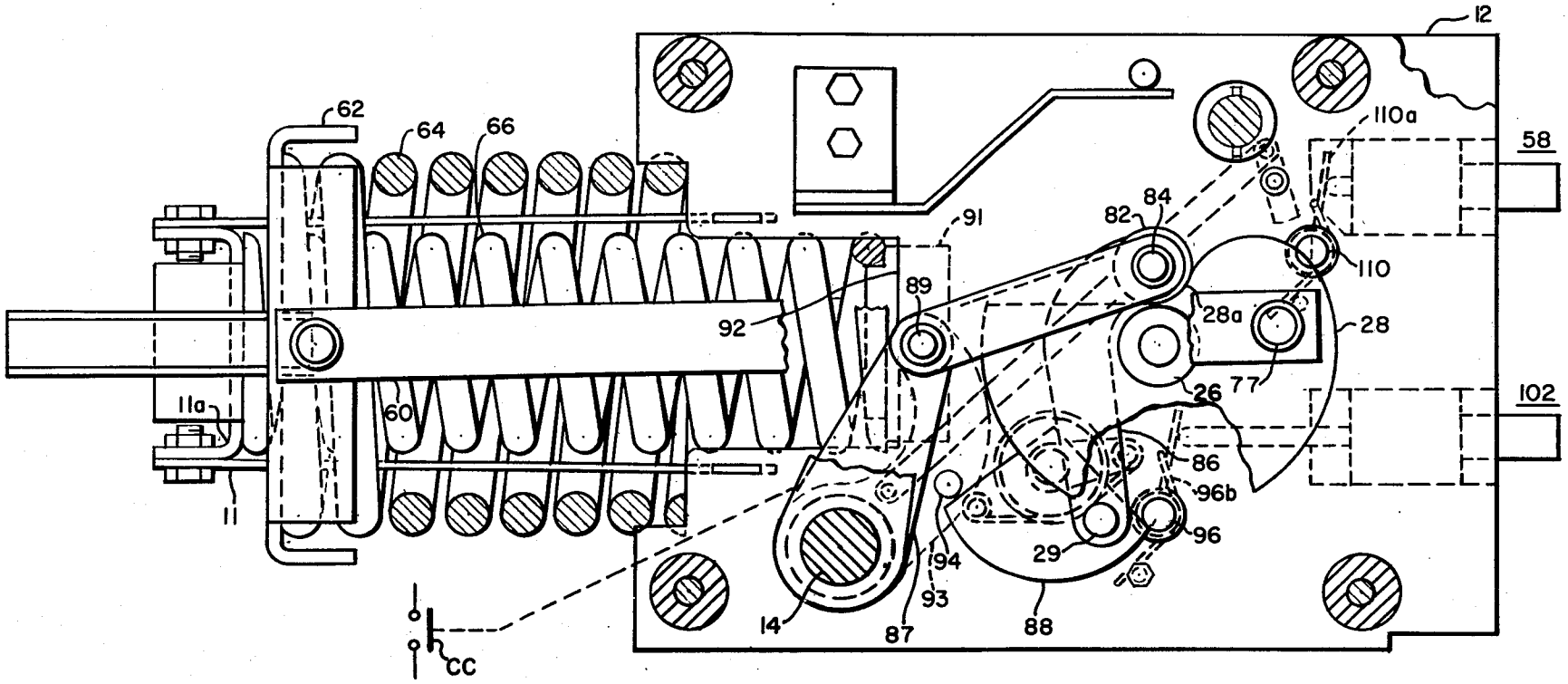
FIG. 6 shows a view similar to that shown in FIG. 5 but with the apparatus in a final stage of the second operating position.

Referring now specifically to FIGS. 1 through 6, the operation of the circuit breaker operating mechanism 10 as it is changed from a first position, as shown in FIGS. 1 through 4, to a second position as shown in FIGS. 5 and 6, is illustrated. In the first position, the circuit breaker contacts CC are closed. The opening spring 66 is charged and the closing spring 64 is also charged. In the second position, the circuit breaker contacts CC are opened. The opening spring 66 is discharged and the closing spring 64 remains charged. There is an intermediate state, best illustrated in FIG. 5, in which portions of the circuit breaker apparatus assume a certain temporary disposition when the circuit breaker apparatus changes from the first position to the second position. The operation of the circuit breaker apparatus operating mechanism 10 as it moves from the first position to the second position corresponds generally to a circuit breaker contact opening operation with the capability existing for an immediate reclosure if necessary. To open the circuit breaker contacts CC, the trip coil 102 is either magnetically or manually actuated to move the plunger member **102*a* to the left as viewed in FIG. 2, for example, to rotate a lever 96*a* which is attached to the opening release shaft or trip shaft 96. This action causes a counterclockwise rotation of the trip release shaft 96 as viewed in FIG. 2, so that the semicircular cutaway portion of the trip release shaft becomes aligned with the arcuate shaped trip latch 88 in such a manner as to allow the trip latch 88 to rotate counterclockwise as viewed in FIG. 2. When this happens, pivot pin 29 moves in a counterclockwise arc as viewed in FIG. 2. It will be noted that the banana link 86, the main link 85, the link 87, the jack shaft 14 and the opening spring crank 93 maintain the yoke 91 in the position shown in FIG. 2 when the trip latch 88 is locked in place by the trip release latch 96 as shown in FIG. 2. This of course maintains the opening spring 66 in a charged or compressed disposition between the yoke 91 and upper end support 11*a*. The previously described counterclockwise rotational movement of the trip release shaft 96 allows the banana link 86 and the main link 85 to move upwardly at the junction pivot 84 to change the disposition of the junction pin 84 from that shown in FIG. 2 to that shown in FIG. 5. The force for causing the previously mentioned change in disposition is caused by the expansion of the opening spring 66 which causes the yoke 91 to move as far to the right in FIGS. 2 and 5 as the ledge 92 allows. This rotates the opening spring crank 93 and the rigidly attached jack shaft 14 in the clockwise direction as shown in FIG. 5. This causes the link 87 to rotate correspondingly, which in turn, causes the common link pin 89 between the main link 85 and the link 87 to move in a clockwise arcuate path to allow the pin 84 to assume the position shown in FIG. 5. The bumper 83 prevents further motion of the pin 84 and its associated roller 82 in the upward direction as shown in FIG. 5. Since the contacts CC are interconnected with the jack shaft 14, the rotation of the jack shaft 14 in the clockwise direction opens the contacts CC. Of course, as can be seen by reference to FIGS. 2 and 5, the release of the spring 66, which is initiated by the actuation of the plunger 102***a* to the left in FIG. 2, of necessity causes clockwise rotation of the shaft 14. The relatively large force of the expansion of opening spring 66 as transmitted through the previously described linkages to the trip latch 88 overcomes the biasing force of the trip latch return spring 100 until the spring 66 has been completely discharged. However, after the spring 66 has become discharged, the force of the return spring 100 once again is sufficiently large relative to other forces imposed upon the trip latch 88 to rotate the trip latch 88 clockwise past the previously described cutaway in the trip release shaft 96, thus allowing shaft 96 to reset itself by also rotating in a clockwise direction. It will be noted that the full extent of rotational travel of the trip latch 88 during a closing spring discharge operation is limited by the freedom of movement of the various linkages 86 and 85, for example. The presence of the bumper 83 also prevents the arcuate surface of the trip latch 88 from completely clearing the cutaway portion of the trip release latch 96, thus maintaining the trip release latch 96 in the released position—that is, the position engendered by the movement of the plunger 102*a* to the left in FIG. 2. The trip release latch 96 will not reset itself to the position shown in FIG. 2 until the return spring 100 has rotated the trip latch 88 far enough in a clockwise direction for the arcuate surface thereof to clear the cutaway portion of the trip release shaft 96. At this point, the trip release latch return spring 96*b* will rotate the trip release shaft 96 to the position shown in FIGS. 2 and 6. Further rotational movement of the trip release latch 88 is prevented by the presence of the bumper or stop 94. At this point, the relative dispositions of the pivot members 89 and 29 cause the linkages 85 and 86 to assume the position shown in FIG. 6 where the roller or cam follower 82 abuts once again against the surface of the cam 28. At this time, because of the relative rotational disposition of the shaft 26, the cam follower 82 falls into the recess 28*a* of the cam surface of the cam 28. As viewed in FIG. 6, the circuit breaker contacts CC are opened and the opening spring 66 has been discharged but the closing spring 64 remains charged.

Figure 7:
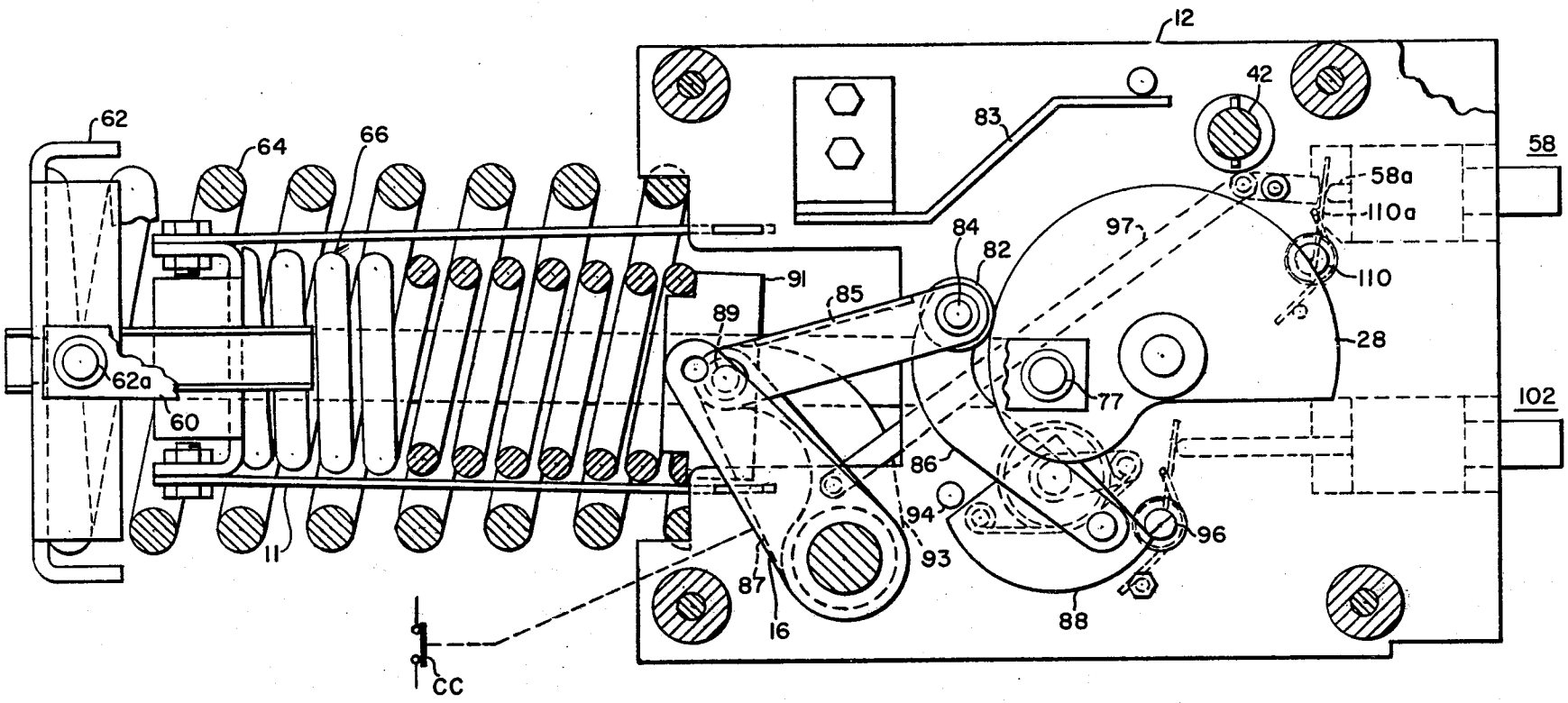
FIG. 7 shows a view similar to those shown in FIGS. 2, 5 and 6, but with the apparatus in a third operating position.
Figure 8:
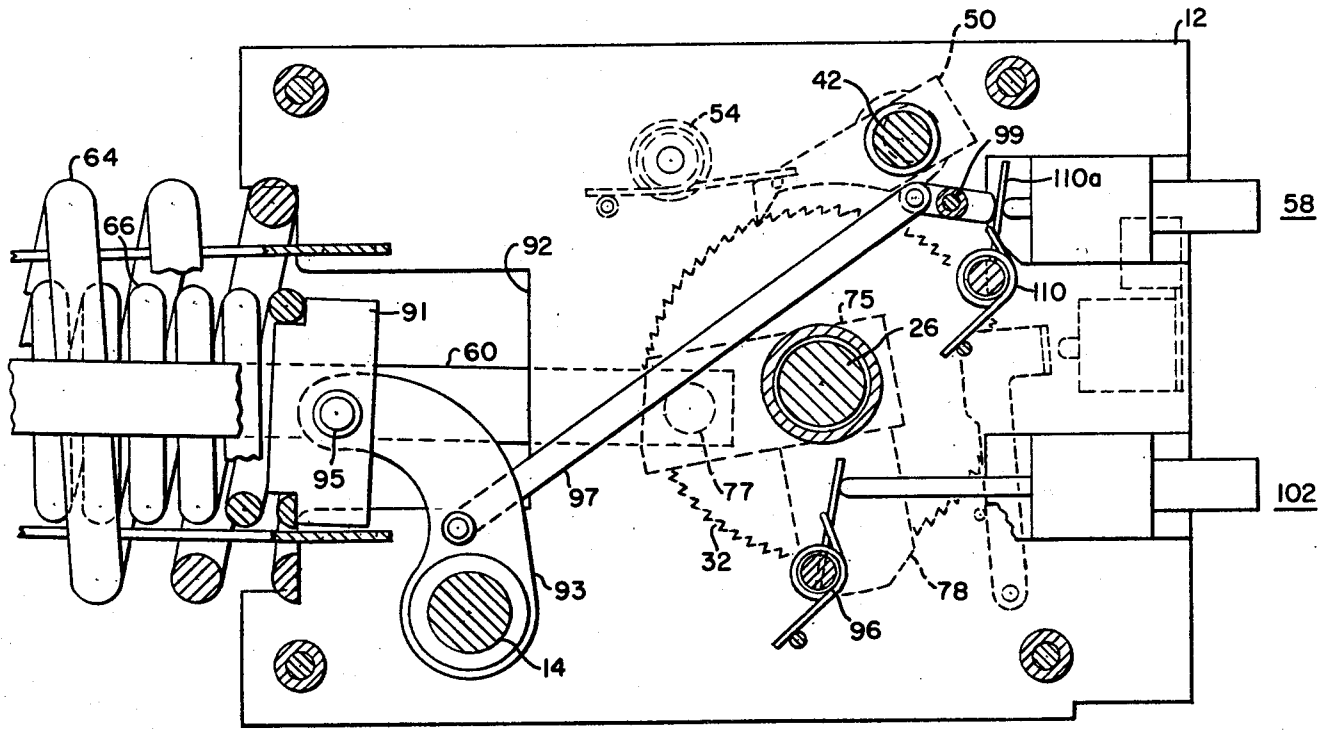
FIG. 8 shows a view similar to that shown in FIG. 3, but with the apparatus in the third operating position.

By referring to FIGS. 4, 5, 6, 7 and 8, the change of status of the circuit breaker operating mechanism 10 from the second position as shown in FIGS. 5 and 6 to a third position as shown in FIGS. 7 and 8 is illustrated. In the third position, (FIGS. 7 and 8) the circuit breaker contacts CC are closed and the closing spring 64 has been discharged while the opening spring 66 has been charged. To accomplish this, the closing coil 58 is either electrically or manually actuated to force the closing coil plunger 58*a* to move to the left, as shown in FIG. 7 thus moving the lever 110*a* in such a manner as to rotate the closing release shaft 110 counterclockwise as viewed in FIG. 8 and clockwise as viewed in FIG. 4. As best shown in FIG. 4, the cutaway portion of the shaft 110 rotates past the edge of the ratchet lock member 78, allowing the spring loaded ratchet 32 to rotate clockwise as viewed in FIG. 4, or counterclockwise as viewed in FIG. 8. The rotational movement of the ratchet 32 is transferred to the cam shaft 26 (as shown in FIG. 7) where it causes a corresponding movement of the cam 28 on the other side of the support members 12 as shown in FIGS. 5, 6 and 7, for example. This allows the pivot pins 77 in both the ratchet 32 and the cam 28 to trace a curvelinear arc, thus allowing the connecting rods 60 to be forced outward by the force of the expanding closing spring 64. As the closing spring 64 discharges between the members 12 and the yoke 62 causing rotation of the cam shaft 28 in a counterclockwise direction from the position shown in FIG. 6 to the position shown in FIG. 7, the roller or shaft follower 82 is forced to move to the left as viewed in FIG. 7 in correspondence to the increasing radius of the cam shaft 28. This causes the main link 85 to transmit force against the link 87 to which it is pinned at 89. This causes the link 87 and the attached jack shaft 14 to rotate in a counterclockwise direction. Rotation of the shaft 14 in a counterclockwise direction causes a rotation of the opening spring crank 93 in the counterclockwise direction as viewed in FIGS. 6 and 7. Since the opening spring crank 93 is pinned to the yoke 91 at the pivot 95 (best shown in FIG. 4), counterclockwise rotational movement of the crank 93 from the position shown in FIG. 6 to the position shown in FIG. 7 causes the yoke to move from right to left in those figures, thus compressing the opening spring 66 between the yoke 91 and the stationary support member 11*a*. It will be noted that the yoke 62 moves from right to left as the operating mechanism 10 changes disposition from that shown in FIG. 6 to that shown in FIG. 7.

In the disposition shown in FIG. 7, the contact closing spring 64 has been relaxed or discharged to its fullest practical extent while the opening spring 66 has been fully compressed or charged for utilization in a subsequent circuit breaker contact opening operation. It will be noted, with respect to FIG. 7, that the circuit breaker contacts CC are at this time closed. At this point, one of two things may happen in regard to the operation of the circuit breaker operating mechanism 10. In the first case, the discharged closing spring 64 may be subsequently charged or the charged opening spring 66 may be discharged once again. The first alternative is exemplified by a change of disposition from that shown in FIGS. 7 and 8 to the disposition shown in FIGS. 1, 2, 3 and 4. The second alternative is exemplified by a change of disposition from that shown in FIGS. 7 and 8 to the disposition shown in FIG. 9.

Referring again to FIGS. 1, 2, 3, 4, 7 and 8, the first alternative as described above is illustrated. This corresponds to a change in the circuit breaker operating mechanism from one of the circuit breaker being closed with the opening spring 66 being charged and the closing spring 64 being discharged to one of the circuit breaker being closed and with the closing spring 64 being charged. In this case, the motor 40 is either manually or automatically actuated to turn the shaft 42 in a counterclockwise direction as shown in FIG. 3 or a clockwise direction as shown in FIG. 4. This causes the eccentric pawl 50 operating under the force of the rotating shaft 42 and the biasing spring 54 to rotate the ratchet 32 in a counterclockwise direction as shown in FIG. 3 or in clockwise direction as shown in FIG. 4. This power ratchet motion has the effect of moving the pins 77 on the connected cam 28 and ratchet 32 to such a disposition that the connecting rod 60 is forced to draw the yoke 62 towards the support pieces 12 thus charging or compressing the closing spring 64. It will be noted by particular reference to FIGS. 2 and 7 that the relative disposition of the members 97, 86, 85, 93, 87 and the jack shaft 14 remains unchanged from the disposition shown in FIG. 7. This is because the radius of the cam 28 is constant as the cam shaft 26 is rotated from the position shown in FIG. 7 to the position shown in FIG. 2. This maintains the yoke 91 in the same position in both cases and maintains the contacts CC closed in both cases; however, it will be noted that the connecting rods 60 have been moved from the position shown in FIG. 7 to the position shown in FIG. 2, thus causing compression of the closing spring 64. At this point, the operating mechanism 10 is in the position described originally—that is, the circuit breaker contacts CC are closed, the opening spring 64 is charged and the closing spring 66 is charged. The circuit breaker is thus ready for a contact opening operation and relatively quick reclosure followed by a second opening if desired.

Figure 9:
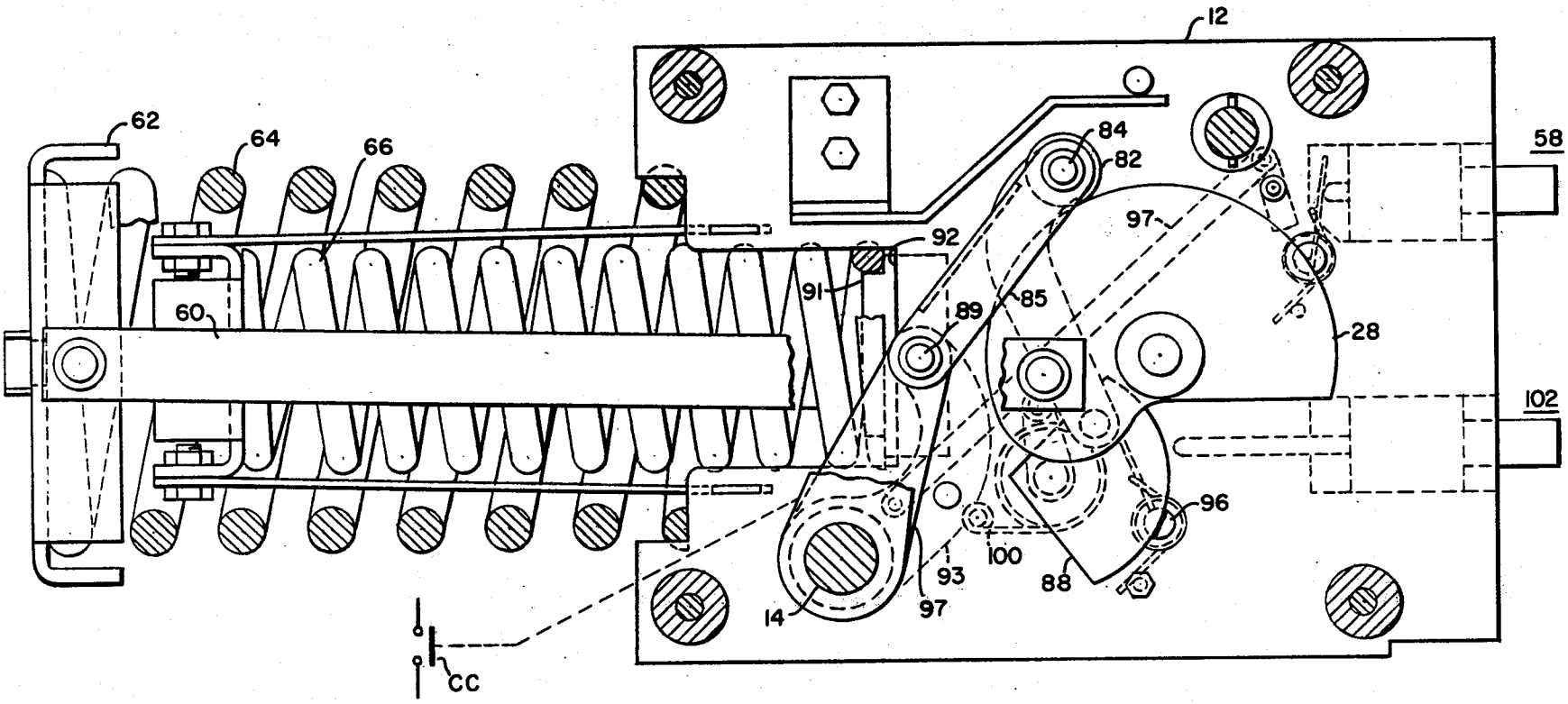
FIG. 9 shows a view similar to those shown in FIGS. 2, 5, 6 and 7, but with the apparatus in a fourth operating position.

Referring now to FIGS. 7, 8 and 9, the second alternative disposition is illustrated. In this case, the charged opening spring 66 is discharged to open the circuit breaker contacts CC even though the closing spring 64 has not been recharged, as was the case with the first alternative. In this case, the release of the yoke 91 as caused by the actuation of the trip coil 102 is the same as was described previously with respect to the discussion of FIGS. 1 through 5. In review, the trip release shaft 96 is rotated in a counterclockwise direction, thus freeing the trip latch 88 from its locked position, thus allowing the yoke 91 to move from left to right as viewed in FIGS. 7 and 9 to thus allow the opening spring 66 to discharge, causing the appropriate rotation of the jack shaft 14 to open the circuit breaker contacts CC. However, it will be noted that although the relative disposition of the interlinking members 97, 85, 86 and 87, for example, are the same as was the case with respect to FIG. 5, the relative disposition of the cam 28 is different. Consequently, even though the bias recovery spring 100 for the trip release latch 88 exerts a recovery force against the trip release latch 88 sufficient to draw the cam follower 82 downwardly, it will fall no further than the cam surface of the cam 28. To change from the disposition shown in FIG. 9 where the circuit breaker conacts CC are open, the closing spring 64 and opening spring 66 are both discharged to the disposition shown in FIGS. 1 through 4 where the circuit breaker contacts CC are closed and the opening spring 64 and closing spring 66 are both charged, it is necessary to actuate the motor 40 as shown in FIG. 1, for example, to rotate the cam 28 to such a position where the closing spring 66 has become charged and the trip latch 88 has become reset. This position is shown in FIG. 6. At this point, the circuit breaker contacts CC remain opened and the opening spring 66 remains discharged, but the closing spring 64 has become charged. At this point, automatic or manual actuation of the closing release mechanism 58 may take place, thus closing the circuit breaker contacts CC and charging the opening spring 66. Finally, the first alternative operation previously discussed may take place, thus placing the circuit breaker apparatus in the disposition shown in FIG. 2 where the circuit breaker contacts CC are closed and where the opening spring 64 and closing spring 66 are both charged.

With respect to the operation of the operating mechanism 10, as is shown in FIGS. 2, 6, 7 and 9, the relatively larger closing spring 64 generally encloses the relatively smaller opening spring 66. The closing spring 64 in this embodiment of the invention must be able to deliver sufficient force to charge the opening spring 66 upon discharge of the closing spring 64. It is to be noted by referring particularly to FIG. 2 that the closing spring 64 is fixed relative to the frame 12 at A, but is movable relative to the frame 12 at B by the motion of the yoke 62. Similarly, the opening spring 66 is fixed relative to frame 12 at C. However, the other end of the opening spring 66 is movable at D relative to the position of the closing spring 64 at A.

It is to be understood with respect to the embodiments of the invention that the apparatus as shown in the figures may operate in the trip free mode of operation—that is, a manual or electrical actuation of the trip coil 102 with an intent to close the circuit breaker on a fault will be prevented by the arrangement of the various operating portions of the operating mechanism 10. It is also to be understood that the concentric spring within a spring arrangement shown in the drawings for one embodiment of the invention is not limiting, and the opening spring 66 may be disposed outside of or separate from the closing spring 64, provided the relative restrictions in freedom of movement of the various ends of the springs correspond to what was described previously. It is to be understood that the apparatus may be utilized on many types of circuit breaker apparatus which include, but ar not limited to, gas blast circuit breakers, magnetic circuit breakers, air type circuit breakers and vacuum circuit interrupters. It is to be understood that the schematic representation of the contacts CC shown in the figures is not limiting, but is merely shown for purposes of clear illustration.

The invention taught herein has many advantages. One advantage lies in the fact that the utilization of one spring inside another provides for an efficiency of space and volume. Another advantage lies in the fact that the embodiment of the invention associated with placing one spring inside the other provides a symmetry to the loading members of the apparatus which help to avoid deflections in the various shafts, such as the jack shaft 14. Another advantage lies in the fact that the opening and closing springs are charged by compression, rather than by a combination of compression and tension, as is the case in the known prior art. Because the springs are utilized in a mode of compression to charge and in a mode of relaxation to discharge, the likelihood of permanent deflection of the spring by exceeding its Hook's Law Modulus of Elasticity is avoided. Said in another way, this means that it is difficult to permanently distort the springs when they are used in compression.

We claim:

1. A circuit interrupter operating mechanism, comprising:

(a) a support;

(b) contact closing means disposed upon said support and disposable in mechanical relationship with the contacts of a circuit interrupter for closing said contacts;

(c) releasable contact opening means disposed upon said support and disposable in mechanical relationship with said contacts of said circuit interrupter for opening said contacts;

(d) closing spring means disposed upon said support, said closing spring means having a first end which is disposed in fixed relation with said support and a second end which is movable relative to said support between a first fixed position when said closing spring means is charged and a second fixed position when said closing spring means is discharged, said second end being disposed in mechanical relationship with said contact closing means to initiate a closing operation for said contact closing means upon discharge of said closing spring means;

(e) opening spring means disposed upon said support within said closing spring means, said opeing spring means having a first end which is affixed to said support and a second end which is connected in mechanical relationship with said contact opening means and which is maintained in a generally fixed position thereby prior to release of said contact opening means, said second end of said opening spring means being interconnected mechanically with said second end of said closing spring means for being moved by said second end of said closing spring means during the discharging of said closing spring means to thereby charge said opening spring means in compression, said second end of said opening spring means moving upon release of said contact opening means to discharge said opening spring means independently of said closing spring means to thus force an opening operation in said contact opening means;

(f) charging means disposed upon said support for charging said closing spring means; and (g) releasing means disposed upn said support for releasing said contact opening means.

2. A circuit interrupter operating mechanism, comprising:

(a) a support;

(b) a contact closing cam disposed upon said support and disposable in mechanical relationship with the contacts of a circuit interrupter for closing said contacts;

(c) releasable contact opening means disposed upon said support and disposable in mechanical relationship with said contacts of said circuit interrupter for opening said contacts;

(d) a helical closing spring of first diameter disposed upon said support, said closing spring having a first end which is disposed in fixed relation with said support and a second end which is movable relative to said support between a first fixed position when said spring is charged and a second fixed position when said spring is discharged, said second end being disposed in mechanical relationship with said contact closing cam to initiate a closing operation for said contact closing cam upon discharge of said closing spring;

(e) a helical opening spring of second diameter smaller than said first diameter disposed upon said support within said closing spring, said opening spring having a first end which is affixed to said support and a second end which is connected in mechanical relationship with said contact opening means and which is maintained in a generally fixed position thereby prior to release of said contact opening means, said second end of said opening spring being interconnected mechanically with said second end of said closing spring for being moved by said second end of said closing spring during the discharge of said closing spring to thereby charge said opening spring in compression, said second end of said opening spring moving upon release of said contact opening means to discharge said opening spring independently of said closing spring to thus force an opening operation in said contact opening means;

(f) a motor disposed upon said support for charging said closing spring; and (g) releasing means disposed upon said support for releasing said contact opening means.

3. A circuit interrupter, comprising:

(a) a base;

(b) separable main contacts disposed upon said base;

(c) an operating mechanism support disposed upon said base;

(d) contact closing means disposed upon said support and disposed in mechanical relationship with said contacts for closing said contacts;

(e) releasable contact opening means disposed upon said support and disposed in mechanical relationship with said contacts for opening said contacts;

(f) closing spring means disposed upon said support, said closing spring means having a first end which is disposed in fixed relation with said support and a second end which is movable relative to said support between a first fixed position when said closing spring means is charged and a second fixed position when said closing spring means is discharged, said second end being disposed in mechanical relationship with said contact closing means to initiate a closing operation for said contact closing means upon discharge of said closing spring means;

(g) opening spring means disposed upon said support within said closing spring means, said opening spring means having a first end which is affixed to said support and a second end which is connected in mechanical relationship with said contact opening means and which is maintained in a generally fixed position thereby prior to release of said contact opening means, said second end of said opening spring means being interconnected mechanically with said second end of said closing spring means for being moved by said second end of said closing spring means during the discharging of said closing spring means to thereby charge said opening spring means in compression, said second end of said opening spring means moving upon release of said contact opening means to discharge said opening spring means independently of said closing spring means to thus force an opening operation in said contact opening means;

(h) charging means disposed upon said support for charging said closing spring means; and (i) releasing means disposed upon said support for releasing said contact opening means.

* * * * *